US005970873A

United States Patent [19]

DeBoer et al.

[11] Patent Number: 5,970,873

[45] Date of Patent: Oct. 26, 1999

[54] IMAGING AND PRINTING METHODS TO FORM IMAGING MEMBER BY FORMATION OF INSOLUBLE CROSSLINKED POLYMERIC SOL-GEL MATRIX

[75] Inventors: Charles D. DeBoer, Palmyra; Judith L. Fleissig, Rochester, both of N.Y.

[73] Assignee: Eastman Kodak Company, Rochester, N.Y.

[21] Appl. No.: 09/067,247

[22] Filed: Apr. 27, 1998

[51] Int. Cl.[6] ..... B41C 1/10

[52] U.S. Cl. ..... 101/466; 101/455; 101/457; 101/462

[58] Field of Search ..... 101/453, 454, 101/455, 457, 462, 460, 463.1, 465, 466, 467

[56] References Cited

U.S. PATENT DOCUMENTS

| | | | |
|---|---|---|---|
| 1,941,001 | 12/1933 | Hansell | 346/97 |
| 3,373,437 | 3/1968 | Sweet et al. | 347/74 |
| 3,416,153 | 12/1968 | Hertz et al. | 347/73 |
| 3,878,519 | 4/1975 | Eaton | 347/75 |
| 4,003,312 | 1/1977 | Gunther | 101/466 |
| 4,303,924 | 12/1981 | Young, Jr. | 347/102 |
| 4,346,387 | 8/1982 | Hertz | 347/75 |
| 4,599,627 | 7/1986 | Vollert | 347/20 |
| 4,606,985 | 8/1986 | Takaya et al. | 101/453 |
| 4,833,486 | 5/1989 | Zerillo | 101/463.1 |
| 4,976,997 | 12/1990 | Stockel et al. | 101/465 |
| 5,206,102 | 4/1993 | Tench | 101/467 |
| 5,292,591 | 3/1994 | Teyssie et al. | 101/453 |
| 5,360,834 | 11/1994 | Popall et al. | 430/302 |
| 5,466,658 | 11/1995 | Harrison et al. | 503/227 |
| 5,495,803 | 3/1996 | Gerber et al. | 101/401.1 |
| 5,501,150 | 3/1996 | Leenders et al. | 101/466 |
| 5,511,477 | 4/1996 | Adler et al. | 101/401.1 |
| 5,695,908 | 12/1997 | Furukawa | 101/466 |
| 5,738,013 | 4/1998 | Kellett | 101/463.1 |

FOREIGN PATENT DOCUMENTS

| | | |
|---|---|---|
| 0 776 763 A1 | 11/1995 | European Pat. Off. . |
| 53-015905A | 2/1978 | Japan . |
| 56-105960A | 8/1981 | Japan . |
| 62-025081 | 2/1987 | Japan . |

*Primary Examiner*—Stephen R. Funk
*Attorney, Agent, or Firm*—J. Lanny Tucker

[57] ABSTRACT

An imaging member can be prepared by imagewise application of a mixture of a sol precursor in a liquid to a suitable substrate. Application is preferably accomplished by ink jet printing. Upon removal of the liquid, such as by drying, an insoluble, crosslinked polymeric sol-gel matrix is formed that will accept a lithographic printing ink. The resulting imaging member can be used for lithographic printing.

22 Claims, No Drawings

IMAGING AND PRINTING METHODS TO FORM IMAGING MEMBER BY FORMATION OF INSOLUBLE CROSSLINKED POLYMERIC SOL-GEL MATRIX

FIELD OF THE INVENTION

This invention relates to a method used to prepare imaging members by application of an ink jetable fluid onto a suitable substrate to form an insoluble, crosslinked polymeric sol-gel matrix. The invention also relates to a method of using the imaging members for offset printing.

BACKGROUND OF THE INVENTION

The art of lithographic printing is based upon the immiscibility of oil and water, wherein the oily material (or ink) is preferentially retained by image areas on a substrate. When a suitably prepared surface is moistened with water and an ink is applied, the background or non-image areas retain the water and repel the ink. The image areas then accept the ink and repel the water. Ink on the image areas can then be transferred to the surface of a suitable receiving material, such as cloth, paper or metal, thereby reproducing the image. Commonly, the ink is transferred to an intermediate material known as a blanket which in turn transfers the ink image to the surface of the final receiving material upon which the image is to be reproduced.

Conventional lithographic printing plates typically include a hardenable polymeric layer (usually visible or UV light-sensitive) on a suitable metallic or polymeric support. Both positive- and negative-working printing plates can be prepared in this fashion. Upon exposure, and perhaps post-exposure heating, either imaged or non-imaged areas are removed using wet processing chemistries.

Thermally sensitive printing plates are also known. They include an imaging layer comprising a mixture of dissolvable polymers and an infrared radiation absorbing compound. While these plates can be imaged using lasers and digital information, they require wet processing using alkaline developers to provide the printable image.

Dry planography, or waterless printing, is well known in the art of lithographic offset printing and provides several advantages over conventional offset printing. Dry planography is particularly advantageous for short run and on-press applications. It simplifies press design by eliminating the fountain solution and aqueous delivery train. Carefuil ink water balance is unnecessary, thus reducing rollup time and material waste. Use of silicone rubber, [such as poly (dimethylsiloxane) and other derivatives of poly(siloxanes)] have long been recognized as preferred waterless-ink repelling materials.

In the lithographic art, materials that release or repel oil based inks are usually referred to as having "oleophobic" character. Herein, ink repelling materials are defined as "melanophobic" and, conversely, the term "melanophilic" is used to describe ink "loving" or accepting materials.

The planographic materials noted above are the object of considerable development effort in the industry, but due to a number of performance problems or costs, there remains a need to explore other means for providing printed images using sources of digital information, such as digitally controlled printing devices.

Many different types of digitally controlled imaging or printing systems are known. These systems utilize a variety of actuation mechanisms, marking materials and recording media. Examples of such systems include, but are not limited to, laser electrophotographic printers, LED electrophotographic printers, dot matrix impact printers, thermal paper printers, film recorders, thermal wax printers, dye diffusion thermal transfer printers, and ink jet printers. Due to various disadvantages or limitations, such digital printing systems have not significantly replaced mechanical printing presses and the more conventional printing plates described above, even though these older systems are labor intensive and inexpensive only when more than a few thousand copies of the same image are wanted. Yet, there is considerable activity in the industry to prepare and use recording media that can be digitally imaged and used to provide high quality, inexpensive copies in either a short- or long-run job.

Ink jet printing has become recognized as a viable alternative in the industry because of its non-impact deposition of ink droplets, low-noise characteristics, its use of plain paper as a receiving material, and its avoidance of toner transfer and fixing (as in electrophotography). Ink jet printing mechanisms can be characterized as either continuous ink jet or "drop on demand" ink jet printing. Various ink jet printers and systems are currently available for a number of markets, including their common use with personal computers. A very essential aspect of such systems, of course, is a printing ink that has all of the necessary properties for a given application.

Various teachings about ink jet printing including nozzles and drop modulation are described, for example, in U.S. Pat. No. 1,941,001 (Hamsell), U.S. Pat. No. 3,373,437 (Sweet et al), U.S. Pat. No. 3,416,153 (Hertz et al), U.S. Pat. No. 3,878,519 (Eaton), and U.S. Pat. No. 4,346,387 (Hertz).

Conventional continuous ink jet printing utilizes electrostatic charging "tunnels" that are placed close to the point where the ink drops are formed in a stream. In this manner, individual drops may be charged, and these drops may be deflected downstream by the presence of deflector plates that have a large potential difference between them. A gutter (sometimes known as a "catcher") may be used to intercept the charged drops, while the uncharged drops are free to strike the recording medium. If there is no electric field present, or if the drop break off point is sufficiently far from the electric field (even if a portion of the stream before the drop break off point is in the presence of an electric field), then charging will not occur. In order to avoid these complications and uncertainties, it is desirable to avoid the use of electrostatic charging tunnels when using ink jet printing.

Printing plates have been made using ink jet printing and various techniques, as described for example in U.S. Pat. No. 4,003,312 (Gunther), U.S. Pat. No. 4,833,486 (Zerillo), U.S. Pat. No. 5,501,150 (Leenders et al), U.S. Pat. No. 4,303,924 (Young), U.S. Pat. No. 5,511,477 (Adler et al), U.S. Pat. No. 4,599,627 (Vollert), U.S. Pat. No. 5,466,658 (Harrison et al), and U.S. Pat. No. 5,495,803 (Gerber et al).

JP Kokai 53-015905 describes the preparation of a printing plate by ink jet printing using an ink comprising an alcohol-soluble resin in an organic solvent onto an aluminum support. Similarly, JP Kokai 56-105960 describes ink jet printing using an ink comprising a hardening substance, such as an epoxy-soybean oil, and benzoyl peroxide, or a photohardenable polyester, onto a metallic support. These inks are disadvantageous in that they include light-sensitive materials or environmentally unsuitable organic solvents.

EP-A-0776,763 (Hallman et al) describes ink jet printing of two reactive inks that combine to form a polymeric resin on a printing plate. JP Kokai 62-25081 describes the use of an oleophilic liquid as an ink jet ink.

Inks for high speed ink jet drop printers must have a number of special characteristics. Typically, water-based inks have been used because of their conductivity and viscosity range. Thus, for use in a jet drop printer the ink must be electrically conductive, having a resistivity below about 5000 ohm-cm and preferably below about 500 ohm-cm. For good fluidity through small orifices, the water-based inks generally have a viscosity in the range between 1 and 15 centiposes at 25° C.

Beyond this, the inks must be stable over a long period of time, compatible with ink jet materials, free of microorganisms and functional after printing. Required functional characteristics include resistance to smearing after printing, fast drying on paper, and being waterproof when dried.

Thus, problems to be solved with ink jet inks include the large energy needed for drying, cockling of large printed areas on paper surfaces, ink sensitivity to rubbing, the need for an anti-microbial agent and clogging of the ink jet printer orifices from dried ink.

Some of these problems may be overcome by use of polar, conductive organic solvent based ink formulations. However, non-polar solvents generally lack sufficient conductivity. Addition of solvent soluble salts can make such solvents conductive, but such salts are often toxic, corrosive and unstable, and therefore present a number of reasons why they should be avoided.

It would be desirable to have a means for preparing printing plates using ink jet printing techniques in an economical fashion, at high speed without the limitations of requiring an electrically conductive ink and without the problems noted above. It is also desirable that printing plates prepared in this fashion would be long wearing, that is be useful for long press runs.

SUMMARY OF THE INVENTION

The problems noted above are overcome by use of the imaging method of this invention. This method comprises the steps of:

A) imagewise applying a mixture of a sol precursor and a liquid as a thin layer to a substrate, and B) removing the liquid from the thin layer to form, imagewise, an insoluble, crosslinked polymeric sol-gel matrix.

In some embodiments of this invention, the noted method further includes the steps of:

C) contacting the insoluble, crosslinked polymeric sol-gel with a lithographic printing ink, and D) imagewise transferring the printing ink to a receiving material.

This invention also provides an imaging member that is prepared using the method described above.

In preferred embodiments, the sol precursor is a di- or triether, or di- or triester of a metal oxide, the metal oxide also having at least one melanophilic non-ether or non-ester side chain that has up to 25% of its molecular weight being contributed by oxygen, nitrogen or sulfur atoms, and the rest of its molecular weight being contributed by carbon and hydrogen atoms, the metal oxide being a silicon, beryllium, magnesium, aluminum, germanium, arsenic, indium, tin, antimony, tellurium, lead, bismuth or transition metal oxide.

This invention also provides a method of preparing a lithographic printing plate comprising providing a water-insoluble melanophilic image on the surface of a melanophobic printing plate support, by imagewise applying the mixture noted above as an ink jetable fluid, to the surface. The applied fluid dries to form a durable, solvent-insoluble, crosslinked polymeric sol-gel matrix on the support. Drying can be facilitated by application of heat as described in detail below.

The ink jetable fluids described herein can be used to advantage to make imaging members, such as lithographic printing plates, thereby avoiding many problems with conventional means for making such articles. The fluids have appropriate viscosity and surface tension for application using ink jet techniques, and can be either electrically conductive or non-conductive. The fluid solvents are generally environmentally friendly. Upon drying, the sol precursor in the fluid chemically crosslinks to form a tough, inorganic polymeric sol-gel matrix on the surface of a support that provides long press runs for the printing members.

DETAILED DESCRIPTION OF THE INVENTION

The following description of this invention is directed to the use of particular embodiments of ink jetable fluids, printing members and methods of their preparation and use. It is to be understood that embodiments not specifically described, but which would be variations obvious to one skilled in the art, are also included within the present invention.

The printable image on the surface of the printing member is provided by imagewise applying in any suitable fashion (such as by ink jet printing) a fluid or mixture of a liquid (or solvent) and sol precursor that forms an insoluble inorganic polymeric sol-gel matrix upon drying.

The fluid comprises one or more solvents as a carrier medium, such as water, polar organic solvents such as alcohols (such as ethanol, isopropanol, methanol and n-propanol), polyhydric alcohols (such as ethylene glycol, diethylene glycol, triethylene glycol and trimethylol propane), non-polar organic solvents (such as butanone, tetrahydrofuran or toluene). Water and ethanol are preferred. Mixtures of such solvents can also be used if desirable. It is best that such liquids be readily removed from the substrate by drying, wicking or other appropriate techniques. Thus, they must have appropriate boiling points, viscosities and other properties that make them easy to remove.

Dispersed or dissolved within the solvent(s) is one or more sol precursors. What is meant by "sol precursor" is a compound (or combination of compounds) that upon drying, forms a porous colloidal or "sol-gel" upon removal of liquid solvent or dispersing medium. "Sols" is a term known to refer to a colloidal system of liquid character in which the dispersed particles (for example, of sol precursors) are either solid or large molecules whose dimensions are in the colloidal range (1–1000 nm in size). A "gel" is a colloidal system of solid character in which the dispersed sol precursor forms a continuous, coherent matrix interpenetrated (usually by liquid) by kinetic units smaller than colloidal units. A detailed -discussion of sol-gels and their precursor materials, methods of preparation and background literature is provided by Gesser & Goswami in *Chem. Rev.*, Vol. 89, pages 765–788, 1989, incorporated herein by reference for its background information. It is clear that sol-gel matrices can be prepared using a variety of techniques for removing the dispersing liquid.

The sol-gel matrices formed according to this invention can be formed from one or more metal oxides of silicon, beryllium, magnesium, aluminum, germanium, arsenic, indium, tin, antimony, tellurium, lead, bismuth or transition metals. For purposes of this application, silicon is considered a "metal". Silicon oxide, aluminum oxide, titanium oxide and zirconium oxide compounds are preferred, and silicon oxide and titanium oxide compounds are most preferred, in the practice of this invention. Silicon oxide, aluminum oxide, titanium oxide and zirconium oxide are preferred for this use. Mixtures of oxides can also be used in any combination and proportions.

The sol-gel matrix can be composed completely of inorganic oxide(s), but in generally, it may be desirable to include one or more organic binder materials therein, including gelatin and other hydrophilic colloids, acrylate (and methacrylate) polymers or polyvinyl alcohol. Crosslinked gelatin is most preferred in this embodiment.

Generally, the amount of the one or more metal oxides in the liquid is at least 1, and preferably at least 10 weight %, and can be as high as 50 weight %.

The surface tension of the mixture used in this invention is generally at least 20 and preferably at least 30 dynes/cm, and generally up to 60 and preferably up to 50 dynes/cm. Surface tension can be measured in a conventional manner, for example, using a commercially available du Nony Tensiometer (Scientific Products, McGaw Park, Ill.). Fluid viscosity can be generally no greater than 20 centipoise, and preferably from about 1 to about 10, and more preferably from about 1 to about 5, centipoise. Viscosity is measured in a conventional manner, for example, using a commercially available Brookfield Viscometer.

Where the sol-gel matrix includes organic components, the weight of the matrix is at least 10% by weight of carbon, and preferably, at least 25% by weight of carbon.

More preferably, the metal oxide is a di- or triether, or di- or triester metal oxide having at least one melanophilic non-ether or non-ester side chain. This non-ether or non-ester side chain is predominantly hydrocarbon in composition. That is, from 0 and up to 25% of the hydrocarbon side chain molecular weight is contributed by oxygen, nitrogen or sulfur atoms, and the rest of its molecular weight is contributed by carbon and hydrogen atoms.

Preferably, the metal oxide compound includes two or three ether or ester groups having from 1 or more oxygen atoms, and from 1 to 10 carbon atoms, and preferably from 1 to 3 carbon atoms. Useful ether and ester groups include, but are not limited to, methoxy, ethoxy, methoxymethyl, ethoxyethyl, acetoxy, propionic esters and other groups that would be readily apparent to one skilled in the art. Preferably, the ether groups are methoxy or ethoxy.

The melanophilic non-ether and non-ester side chain is an alkyl-substituted or unsubstituted phenyl (such as p-methylphenyl, xylyl and mesityl), or an aryl-substituted or unsubstituted alkyl group having 1 to 16 carbon atoms. By "melanophilic" it is meant that it is oil accepting and water repelling. Preferably, this side chain is one of the alkyl groups noted above (such as methyl, ethyl, n-propyl, isopropyl, n-butyl, n-hexyl and benzyl).

Preferably, the contribution by oxygen, nitrogen or sulfur atoms to the molecular weight of the non-alkoxy side chain is from 0 to 25%, and more preferably from 0 to 10%.

Representative compounds of this type include, but are not limited to, phenyltrimethoxysilane, phenyltriethoxysilane, ethyltrimethoxysilane, 3-aminopropyltriethoxysilane, methacryloxypropyltrimethoxysilane, aminoethylaminopropyltrimethoxysilane, triethoxysilanylethane, octyltriethoxysilane and isobutyltriethoxysilane, hafnium isopropoxide, zirconium isopropoxide, copper bis(2,2,6,6-tetramethyl-3,5-heptanedionate), and tantalum ethoxide. The most preferred compound is 3-ammopropyltriethoxysilane.

The ink jetable mixtures used in this invention can also include other addenda, including organic anionic or non-ionic surfactants to provide the desired surface tension (for example, those described in U.S. Pat. No. 4,156,616, U.S. Pat. No. 5,324,349 and U.S. Pat. No. 5,279,654), humectants or co-solvents to keep the fluid from drying out or clogging the orifices of ink jet print heads, penetrants to help the fluid penetrate the surface of the support. A biocide, such as PROXEL™ GXL biocide (Zeneca Colors) or KATHON™ XL biocide (Rohm and Haas) may also be included to prevent microbial growth. Other addenda may be thickeners, pH adjusters, buffers, conductivity enhancing agents, drying agents and defoamers. The amounts of such materials in the fluids would be readily apparent to one skilled in the art. Preferably, the fluids are colorless, but may also contain soluble or dispersed colorants.

The ink jetable fluids can be applied to suitable metallic or heat-dimensionally stable supports, such as polymeric films, metallic sheets or foils, papers, or laminates thereof. Polymeric materials include polyesters (such as polyethylene terephthalate), polycarbonates and polyimides. Preferably, the support is metallic such as aluminum, zinc or steel, more preferably, it is aluminum that has a grained oxidized surface. Suitable supports can be prepared using techniques well known in the lithographic printing plate art. The thickness of the support can be varied, as long as it is sufficient to sustain the wear of a printing press and thin enough to wrap around a printing form. Polyester supports are generally from about 100 to about 200 $\mu$m in thickness, and metallic supports are generally from about 100 to about 500 $\mu$m in thickness.

To serve as a printing plate, the support must have a surface that is abhesive towards lithographic printing ink. In the case of conventional offset lithography using an aqueous fountain solution, this means a surface that is hydrophilic and holds water well. In the case of so-called driographic lithography, the surface must repel lithographic printing ink as is, without the aid of a fountain solution. For example, aluminum supports are roughened, or grained by mechanical sanding, and then electrolytically anodized to provide a surface that is hydrophilic and holds water well. Polymeric supports may be coated with a mixture of gelatin, titanox and a crosslinking agent to provide a hydrophilic surface. Many other hydrophilic supports are well known to those skilled in the art of lithographic printing. The back side of the supports can be coated with antistat agents and/or slipping layers or matter layers to improve handling and "feel" of the resulting printing member.

The mixtures of liquid and sol precursors described herein can be applied to the supports in any suitable manner that provides droplets to the surface of the support in an imagewise fashion. Preferably, they are applied using ink jet printing techniques and devices.

Thus, the fluid can be applied using ink jet printing wherein fluid is applied in a controlled, imagewise fashion to the surface of the support by ejecting droplets from a plurality of nozzles or orifices in a print head of an ink jet printer (such as a piezoelectric ink jet printing head). Commercially ink jet printers use various schemes to control the deposition of the droplets. Such schemes are generally of two types: continuous stream and drop-on-demand.

In drop-on-demand systems, the fluid droplets are ejected from orifices directly to a position on the support by pressure created by, for example, a piezoelectric device, an acoustic device, or a resistive heater controlled in accordance with digital signals. Thus, fluid droplets are not generated and ejected through the orifices of the print head unless they are needed to print pixels. Commercially available ink jet printers using such techniques are well known and need not be described in detail here.

Continuous ink jet printers have smaller drops and can be used, but the fluids must be conductive because the fluid droplets are deflected between the receiving material and a collection gutter by electrostatic deflectors.

The ink jetable fluids described herein can have properties compatible with a wide range of ejecting conditions, for example, driving voltages and pulse widths for thermal ink jet printers, driving frequencies of the piezoelectric element for either a drop-on-demand device or a continuous device, and the shape and size of the nozzles.

Once the ink jetable fluid has been applied to the support, the liquid is removed in any suitable fashion, such as drying, wicking, evaporation, sublimation or combinations thereof. Drying can be accomplished using any suitable source of energy that will evaporate the liquid without harming the sol-gel matrix that is formed. Preferably, the imaging member is dried to form the durable, water-insoluble, inorganic polymeric matrix described above. Drying means and conditions can vary depending upon the viscosity of the fluid, the solvent used, and various other features. The applied mixture may be heated to speed up the drying process. Usual drying of the imaging member would be for example at a temperature of at least 100° C. for at least 3 minutes.

The dried sol-gel matrix image on the imaging member is then ready for use in printing. Before inking the image, the imaging member may be treated with an aqueous solution of a natural gum, such as gum acacia, or of a synthetic gum such as carboxymethyl cellulose, as is well known in the art (see for example, Chapter 10 of *The Lithographer's Manual*, edited by Shapiro, The Graphic Arts Technical Foundation, Inc., Pittsburgh, Penn., 1966).

The resulting imaging member having an imagewise melanophilic polymeric matrix on the melanophobic support, can then be inked with a suitable lithographic printing ink, and the inked image is then transferred to a suitable receiving material, such as paper, metal sheets or foils, ceramics, fabrics and other materials known in the art. The image can be transferred directly to the receiving materials, or indirectly by transfer first to a what is known as a blanket roller which in turn transfers the ink image to the receiving material.

The printing members prepared using the present invention can be of any suitable shape or form, including but not limited to, printing plates, printing tapes (or webs), and printing cylinders or drums. Preferably, the printing member is a printing plate.

The following examples are presented to illustrate, but not limit, the present invention.

EXAMPLE 1

This example demonstrates the practice of the present invention using an ink jet printer to apply an ink jetable fluid to a support.

A colorless ink jetable fluid was prepared by mixing 20 g of 3-aminopropyltriethoxysilane and 80 g of water with 0.1 g of SURFYNOL 485 surfactant (Air Products and Chemicals). The fluid was then loaded into a black ink cartridge of a commercially available Epson STYLUS Color 200 ink jet printer by means of a small hole drilled into the cartridge. The commercial black ink had been flushed from the cartridge with water, which was displaced with nitrogen before loading the fluid.

A test page (image) in the memory of the printer was then "printed" onto grained anodized aluminum support by applying the ink jetable fluid in the manner noted above. After baking at 100° C. for 10 minutes, the resulting printing plate with a dried water-insoluble sol-gel matrix was mounted on a commercially available A.B. Dick duplicator printing press and inked using a conventional lithographic ink. One hundred clean impressions were made with a clean background and good ink density in the areas where the sol-gel matrix had been formed after application of the ink jetable fluid.

EXAMPLE 2

Example 1 was repeated except that the grained anodized aluminum support was replaced with a polyethylene terephthlate film that had been coated with a crosslinked layer of gelatin and titanium dioxide. After imaging and baking, the resulting printing plate was used to print two hundred clean impressions.

EXAMPLE 3

Another ink jetable fluid, composed of a 10% solution of 3-aminopropyltriethoxysilane in water, was imagewise dropped onto a grained anodized lithographic aluminum support and allowed to dry to form a suitable solgel matrix. The resulting printing plate was then baked at 100° C. for 15 minutes. The printing plate was then mounted on a conventional A. B. Dick printing press, inked and used to obtain 1000 clear, full density printed impressions.

EXAMPLE 4

Example 3 was repeated except the solution 3-aminopropyltrietioxysilane in water was replaced with an ink jetable fluid composed of 10% octyl triethoxysilane in butanone.

EXAMPLE 5

Example 3 was repeated except the solution of 3-aminopropyltriethoxysilane in water was replaced with an ink jetable fluid composed of 10% iso-butyltriethoxysilane in butanone.

EXAMPLE 6

Example 3 was repeated except the solution of 3-aminopropyltriethoxysilane in water was replaced with an ink jetable fluid composed of hafnium isopropoxide in isopropanol.

EXAMPLE 7

Example 3 was repeated except the solution of 3-aminopropyltriethoxysilane in water was replaced with an ink jetable fluid composed of zirconium isopropoxide in isopropanol.

EXAMPLE 8

Example 3 was repeated except the solution of 3-aminopropyltriethoxysilane in water was replaced with an ink jetable fluid composed of copper bis(2,2,6,6-tetramethyl-3,5-heptanedionate) in butanone.

EXAMPLE 9

Example 3 was repeated except the solution of 3-aminopropyltriethoxysilane in water was replaced with an ink jetable fluid composed of tantalum ethoxide in butanone.

EXAMPLE 10

Example 3 was repeated except the 3-aminopropyltriethoxysilane was replaced with bis-triethoxysilanylethane.

EXAMPLE 11

Example 3 was repeated except the 3-aminopropyltriethoxysilane was replaced with aminoethylaminopropyltrimethoxysilane.

EXAMPLE 12

Example 3 was repeated except the solution of 3-aminopropyltriethoxysilane in water was replaced with an ink jetable fluid composed of 10% methyacryloxypropyltrimethoxysilane in butanone.

EXAMPLE 11

Example 3 was repeated except the solution of 3-aminopropyltriethoxysilane in water was replaced with an ink jetable fluid composed of 10% phenyltrimethoxysilane in butanone.

COMPARATIVE EXAMPLE

Example 3 was repeated except the solution of 3-aminopropyltriethoxysilane in water was replaced with hydrolyzed tetraethoxysilane in a 50:50 mixture of water and ethanol. The resulting printed image was entirely white and would not accept lithographic printing ink. That is, the dried hydrolyzed tetraethoxysilane image would not accept ink. This shows that a non-ether or non-ester side chain that has up to and no more than 25% of its molecular weight being contributed by oxygen atoms with the remainder being contributed by carbon and hydrogen atoms is useful for ink receptivity.

The invention has been described in detail with particular reference to preferred embodiments thereof, but it will be understood that variations and modifications can be effected within the spirit and scope of the invention.

We claim:

1. An imaging method comprising the steps of:

A) imagewise applying a mixture of a sol precursor and a liquid as a thin layer to a substrate, and B) removing said liquid from said thin layer to form, imagewise, an insoluble, crosslinked polymeric sol-gel matrix.

2. The method of claim 1 wherein said substrate is a melanophobic printing plate support, and said insoluble, crosslinked polymeric sol-gel matrix is melanophilic.

3. The method of claim 2 wherein said substrate is an aluminum substrate.

4. The method of claim 1 wherein said mixture further comprises a colorant.

5. The method of claim 1 wherein said insoluble, crosslinked polymeric sol-gel matrix contains at least 10% by weight of carbon.

6. The method of claim 1 wherein said insoluble, crosslinked polymeric sol-gel matrix contains at least 25% by weight of carbon.

7. The method of claim 1 wherein said mixture is applied to said substrate using an ink-jet printing head.

8. The method of claim 7 wherein said mixture is applied to said substrate using a piezoelectric ink jet printing head.

9. The method of claim 1 wherein said sol precursor is a di- or triether, or di- or triester of a metal oxide or mixture thereof, said metal oxide having at least one melanophilic non-ether or non-ester side chain that has up to 25% of its molecular weight being contributed by oxygen, nitrogen or sulfur atoms, and the rest of its molecular weight being contributed by carbon and hydrogen atoms, said metal oxide being a silicon, beryllium, magnesium, aluminum, germanium, arsenic, indium, tin, antimony, tellurium, lead, bismuth, or a transition metal oxide.

10. The method of claim 9 wherein said metal oxide is a silicon oxide, aluminum oxide, titanium oxide or zirconium oxide.

11. The method of claim 10 wherein said metal oxide is silicon oxide.

12. The method of claim 9 wherein said metal oxide comprises two or three ether groups having 1 to 10 carbon atoms.

13. The method of claim 9 wherein said melanophilic non-ether or non-ester side chain is and alkyl-substituted or unsubstituted phenyl or an aryl-substituted or unsubstituted alkyl group having from 1 to 16 carbon atoms.

14. The method of claim 13 wherein said melanophilic non-ether or non-ester side chain is an unsubstituted alkyl group having form 1 to 3 carbon atoms.

15. The method of claim 9 wherein the contribution to the moleculare weight of said side chain by oxygen, nitrogen or sulfur atoms is from 0 to 10%.

16. The method of claim 1 wherein said liquid is an organic polar solvent, or mixture thereof.

17. The method of claim 1 wherein said liquid is water.

18. The method of claim 1 wherein said insoluble, crosslinked polymeric sol-gel matrix is composed of titanium dioxide, and crosslinked gelatin.

19. The method of claim 1 wherein said liquid is removed by heating said thin layer at a temperature of at least 100° C. for at least 3 minutes.

20. The method of claim 1 wherein said substrate is a heat-dimensionally stable polymer.

21. The method of claim 1 further comprising:

C) contacting said insoluble, crosslinked polymeric sol-gel matrix with a lithographic printing ink, and D) imagewise transferring said printing ink to a receiving material.

22. An imaging member prepared by the steps of:

A) imagewise applying a mixture of a sol precursor and a liquid as a thin layer to a substrate, and B) removing said liquid from said thin layer to form, imagewise, an insoluble, crosslinked polymeric sol-gel matrix.

* * * * *